US011234476B2

(12) United States Patent
Veronese et al.

(10) Patent No.: US 11,234,476 B2
(45) Date of Patent: Feb. 1, 2022

(54) PROTECTIVE HELMET, IN PARTICULAR MOTORCYCLE HELMET, HAVING A SWIVELABLE AND REMOVABLE CHIN PART

(71) Applicant: Bayerische Motoren Werke Aktiengesellschaft, Munich (DE)

(72) Inventors: Andrea Veronese, Selvazzano Dentro (IT); Udo Wattendorf, Munich (DE); Damiano Zanata, Robegano (IT)

(73) Assignee: Bayerische Motoren Werke Aktiengesellschaft, Munich (DE)

( * ) Notice: Subject to any disclaimer, the term of this patent is extended or adjusted under 35 U.S.C. 154(b) by 309 days.

(21) Appl. No.: 16/425,343

(22) Filed: May 29, 2019

(65) Prior Publication Data

US 2019/0274390 A1 Sep. 12, 2019

Related U.S. Application Data

(63) Continuation of application No. PCT/EP2017/076387, filed on Oct. 17, 2017.

(30) Foreign Application Priority Data

Nov. 30, 2016 (DE) ..... 10 2016 223 793.4

(51) Int. Cl.

| | |
|---|---|
| ***A42B 3/32*** | (2006.01) |
| ***A42B 3/08*** | (2006.01) |
| ***A42B 3/06*** | (2006.01) |

(52) U.S. Cl.

CPC ..... *A42B 3/326* (2013.01); *A42B 3/08* (2013.01); *A42B 3/06* (2013.01); *A42B 3/324* (2013.01)

(58) Field of Classification Search

CPC ..... A42B 3/326; A42B 3/324; A42B 3/222; A42B 3/223; A42B 3/32; A42B 3/00; A44B 11/258

(Continued)

(56) References Cited

U.S. PATENT DOCUMENTS 4,769,857 A * 9/1988 Cianfanelli ..... A42B 3/326 2/424
6,125,477 A * 10/2000 Crippa ..... A42B 3/222 2/10

(Continued)

FOREIGN PATENT DOCUMENTS

DE 44 17 658 A1 11/1995
DE 10234330 A1 * 2/2004 ..... A42B 3/0433

(Continued)

OTHER PUBLICATIONS

Translation of DE4417658, Brighella, Gianni, Nov. 23, 1995, translated Aug. 21, 2020 via Espacenet (Year: 1995).*

(Continued)

*Primary Examiner* — Heather Mangine
(74) *Attorney, Agent, or Firm* — Crowell & Moring LLP

(57) ABSTRACT

A protective helmet has a jet helmet part and a chin part which are releasably connected to each other by a coupling part. The chin part and the jet helmet part can be swiveled relative to each other by a swiveling mechanism between an integral helmet position and a jet helmet position. The coupling part includes a coupling element on the chin part and a second coupling element on the jet helmet part, which coupling elements engage to form a mutually releasable form-fit coupling. The swiveling mechanism actuates a locking mechanism where the locking mechanism includes a blocking slider and is designed such that, in the integral helmet position, the blocking slider blocks the first coupling element such that a decoupling of the coupling elements is (Continued)

prevented, and in the jet helmet position, the blocking of the first coupling element is released thereby enabling the coupling elements to be decoupled.

15 Claims, 4 Drawing Sheets

(58) Field of Classification Search
USPC ..... 2/421
See application file for complete search history.

(56) References Cited

U.S. PATENT DOCUMENTS

| | | | | |
|---|---|---|---|---|
| 6,598,238 | B2 * | 7/2003 | Hong | A42B 3/326 2/424 |
| 6,892,400 | B1 * | 5/2005 | Choi | A42B 3/326 2/424 |
| 2007/0124852 | A1 * | 6/2007 | Pyo | A42B 3/326 2/424 |
| 2008/0216215 | A1 * | 9/2008 | Lee | A42B 3/326 2/424 |
| 2016/0015114 | A1 * | 1/2016 | Berthier | A42B 3/222 2/424 |
| 2018/0213877 | A1 * | 8/2018 | Liao | A42B 3/205 |
| 2019/0274390 | A1 * | 9/2019 | Veronese | A42B 3/08 |
| 2020/0113268 | A1 * | 4/2020 | Liao | A42B 3/205 |
| 2020/0178639 | A1 * | 6/2020 | Jwa | A42B 3/326 |

FOREIGN PATENT DOCUMENTS

| | | | | |
|---|---|---|---|---|
| DE | 10 2014 218 041 | A1 | 3/2016 | |
| EP | 1795081 | A1 * | 6/2007 | A42B 3/222 |
| FR | 2 876 882 | A1 | 4/2006 | |
| WO | WO 2013/044898 | A1 | 4/2013 | |
| WO | WO-2013047930 | A1 * | 4/2013 | A42B 3/326 |
| WO | WO-2015110764 | A1 * | 7/2015 | A42B 3/326 |

OTHER PUBLICATIONS

PCT/EP2017/076387, International Search Report dated Dec. 18, 2017 (Two (2) pages).

German Search Report issued in German counterpart application No. 10 2016 223 793.4 dated Sep. 26, 2017, with Statement of Relevancy (Seven (7) pages).

German Office Action issued in German counterpart application No. 10 2016 223 793.4 dated Sep. 29, 2017 (Four (4) pages).

* cited by examiner

PROTECTIVE HELMET, IN PARTICULAR MOTORCYCLE HELMET, HAVING A SWIVELABLE AND REMOVABLE CHIN PART

CROSS REFERENCE TO RELATED APPLICATIONS

This application is a continuation of PCT International Application No. PCT/EP2017/076387, filed Oct. 17, 2017, which claims priority under 35 U.S.C. § 119 from German Patent Application No. 10 2016 223 793.4, filed Nov. 30, 2016, the entire disclosures of which are herein expressly incorporated by reference.

BACKGROUND AND SUMMARY OF THE INVENTION

A protective helmet is specified. The protective helmet can be, for example, a motorcycle helmet, in particular having a repeatedly swivelable and repeatedly removable chin part. The removal of the chin part can preferably be carried out without a tool. The intended purpose of the protective helmet is not only restricted to motorcyclists but also extends to other personally steered land, air and water vehicles, such as, for example, open motor racing vehicles, snowmobiles, sailplanes, racing boats, hang-gliders, etc.

In principle in such protective helmets, a distinction is drawn between integral helmets, jet helmets, flip-up helmets and multi-helmets. "Integral helmets" have a fixed chin part and preferably a completely closable visor. "Half-shell helmets", also called jet helmets, have no fixed chin part. There are variants with an installed visor or with a sunshade, but also half-shells with a deep-drawn visor and sides drawn somewhat further forward, which are generally designated as three-quarter helmets. Half-shell helmets must protect the forehead, ears and neck. "Flip-up helmets" are a variant of the integral helmet in which the chin part can be flipped up. These are worth recommending in particular for spectacle wearers and make it easier to remove the helmet following an accident. Flip-up helmets with a swivelable chin part are able to flip up the chin part from a lower integral helmet position, located at chin height, into an upper jet helmet position, in particular flipped up through 90°. "Multi-helmets" are helmets with conversion possibilities, normally that of removing the chin part, with which they can be used optionally as an integral helmet or jet helmet. "Multi-helmets" with repeatedly removable chin part are able to remove the chin part from a lower integral helmet position located at chin height, so that a jet helmet or a three-quarter helmet is produced. In "multi-helmets", the chin part can also have an ability to swivel as in the "flip-up helmets" in addition to removability.

The document DE 44 17 658 A1 describes a protective helmet for motorcyclists, which has a helmet dome and a chin strap that can be swiveled with respect to the helmet dome. In order to prevent the chin strap from unintentionally separating from the helmet dome, the visor and the chin strap should be locked with respect to each other such that only when the visor is removed can the chin strap be swiveled into the removal position. This is achieved by means of a stop which is fixed to the dome, which limits the opening range of the helmet visor and the swiveling range of the chin strap. Only after the visor has been removed is it possible to swivel the chin strap into the removal position.

The document DE 10 2014 218 041 A1 describes a motorcycle helmet with a jet helmet part and repeatedly swivelable and repeatedly removable chin part. The chin part is releasably connected to the jet helmet part by a coupling part. For assembly, the chin part is put onto the jet helmet part in a coupling direction, wherein the coupling part closes automatically and either locks automatically or must be locked by the user. For example, the coupling part can be actuated only in a defined position and in all other positions blocked mechanically by the coupling mechanism.

An object to be achieved by at least some embodiments is to specify an alternative, economical and reliable solution for a protective helmet by means of which automatic mechanical blocking of the coupling between jet helmet part and chin part of a protective helmet is achieved.

The protective helmet described here has, according to at least one embodiment, a jet helmet part and a chin part, which are releasably connected to each other via a coupling part. The jet helmet part can be designed not only in classic jet-helmet form but also smaller in the manner of the form of a half-shell helmet or larger in the form of a three-quarter helmet with protective parts drawn further down and forward for the cheek and jaw area. The chin part can then accordingly be molded with shorter or longer webs in the cheek and jaw area and can therefore in the minimum extreme case be present only in the chin area and in the maximum extreme case present as far as the ear area.

The chin part and the jet helmet part are swivelable by means of a swiveling mechanism relative to each other in swiveling directions between an integral helmet position and a jet helmet position. The chin part can, for example, be swiveled relative to the jet helmet part at least between a front lower integral helmet position into an upper and/or rear jet helmet position swiveled upward between about 90° to about 180° for this purpose and lockable in these extreme positions but also in intermediate positions or beyond extreme positions.

The coupling part has a first coupling element, which is fixed to the chin part, and a second coupling element, which is fixed to the jet helmet part. The coupling elements are designed to interengage for mutual releasably form-fitting coupling. The coupling elements are preferably formed in such a way that, as they are coupled, they automatically latch in one another in a form-fitting manner and for uncoupling require separate and therefore intentional actuation by a user.

The protective helmet and/or the coupling part are formed in such a way that a locking mechanism is actuated by a swiveling mechanism. The locking mechanism can in particular be formed in such a way that it is actuated automatically by the swiveling mechanism. The locking mechanism preferably comprises a blocking slider and is preferably configured such that, in the integral helmet position, the blocking slider blocks the first coupling element in such a way that uncoupling of the coupling elements is blocked. In the jet helmet position, the blocking of the first coupling element is preferably released, so that uncoupling of the coupling elements is made possible. As a result of uncoupling the coupling elements, the chin part can be detached from the jet helmet part. The detachment can preferably be carried out without tools.

By means of the blocking slider, unintended uncoupling of the coupling elements or detachment of the chin part from the jet helmet part can be prevented in a particularly efficient way. The fact that the blocking slider is actuated automatically by the chin part mechanism means that no manual locking of the coupling elements is necessary. The coupling elements can, for example, be formed as latching elements, wherein the spring action of the latching elements can advantageously be designed to be weak on account of the locking function by means of the blocking slider.

According to a further embodiment, the first coupling element is connected to the chin part by means of a swivel arm. The swivel arm is preferably moved and swiveled during swiveling of the chin part relative to the jet helmet part. Particularly preferably, the swivel arm has a locking cam, by means of which the blocking slider is displaced during swiveling from the jet helmet position into the integral helmet position, in such a way that the first coupling element is blocked. As a result of the blocking of the first coupling element, uncoupling of the coupling elements is blocked so that the chin part cannot be detached from the jet helmet part. Preferably, the swivel arm is connected to the chin part via a first joint and to the first coupling element via a second joint.

According to a further embodiment, the second coupling element has a female coupling member and the first coupling element has a male coupling member, wherein the coupling members are formed in such a way that the male coupling member can be latched to the female coupling member. The male coupling member can be formed, for example, as a latching lug. The female coupling member can be formed, for example, as a latching recess or latching cutout. Preferably, a form-fitting connection results from latching of the coupling members or by latching of the latching lug and latching recess.

According to a further embodiment, the coupling part is formed in such a way that latching of the latching lug with the latching recess can be released by an unhooking movement. The blocking slider is preferably formed in such a way that the unhooking movement for releasing the latching in the integral helmet position is blocked by the blocking slider. For example, the blocking slider in the integral helmet position can be arranged behind the latching lug in the direction of the unhooking movement, by which means uncoupling of latching lug and latching recess is no longer possible on account of the arrangement of the blocking slider behind the latching lug. Preferably, as the chin part is swiveled into the jet helmet position, the blocking slider is automatically displaced in such a way that the unhooking movement for releasing the latching is released or possible. In particular, the blocking slider can be displaced in such a way that, in the jet helmet position, it is no longer arranged behind the latching lug and can thus no longer block uncoupling of the latching.

According to a further embodiment, the first coupling element is formed in one piece. For example, the first coupling element can consist of a plastic part formed in one piece. In particular, the first coupling element can be an injection molded plastic part. Furthermore, the first coupling element can be formed as a chin part slide, which is swivelably connected to the chin part.

According to a further embodiment, the first coupling element has a guide in which the blocking slider is guided. The blocking slider can be arranged to be displaceable, in particular slidable, within the guide. The guide can, for example, have a plurality of guide elements. For example, the guide elements can be designed as guide hooks, which are preferably formed in one piece with the first coupling element.

According to a further embodiment, the first coupling element also has a slotted guide, in which a guide pin which is fixed to the chin part is guided. The guide pin can, for example, be connected to the first coupling element by a spring element. By means of the swivel arm, which can be connected to the chin part via a first joint and to the first coupling element via a second joint, and the guide pin guided in the slotted guide, a four-link mechanism, by means of which the first coupling element can be swiveled relative to the chin part, can be implemented.

According to a further embodiment, the second coupling element is designed as an insert frame. The latching recess is preferably formed in the insert frame. For example, the second coupling element can be designed as a one-piece plastic part, which is preferably rotationally fixedly connected to the jet helmet part.

According to a further embodiment, in each case one coupling part is arranged on the left and right of a face opening of the protective helmet. The coupling parts or their coupling elements can be designed to be mirror inverted but otherwise identical on the two sides of the protective helmet, in particular relative to the longitudinal mid-axis of the protective helmet, i.e., in the direction of travel.

Further advantages and advantageous embodiments of the protective helmet described here can be gathered from the following text in conjunction with the embodiments described in FIGS. 1 to 8.

Other objects, advantages and novel features of the present invention will become apparent from the following detailed description of one or more preferred embodiments when considered in conjunction with the accompanying drawings.

DETAILED DESCRIPTION OF THE DRAWINGS

In the exemplary embodiments and Figures, identical or identically acting components can each be provided with the same designations. The elements illustrated and their size relationships relative to one another are in principle not to be viewed as to scale. Instead, individual elements can be illustrated as exaggeratedly thick or over-dimensioned for better visualization and/or for better understanding.

Figure 1:
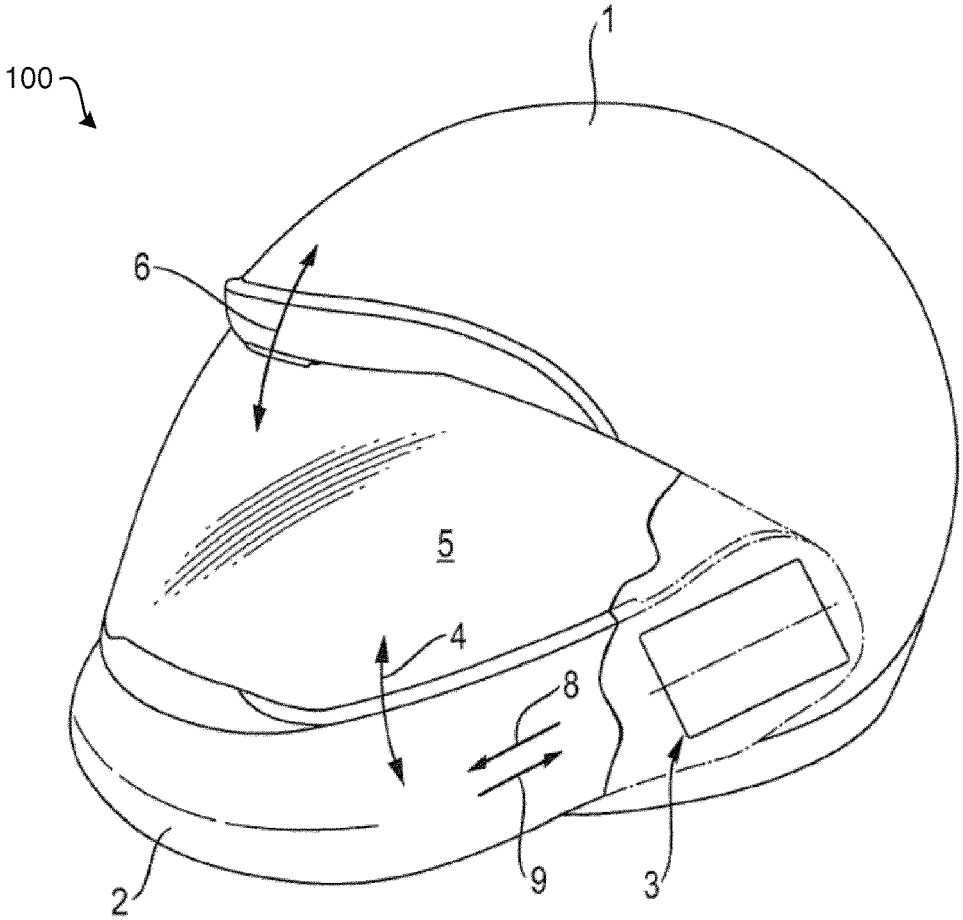
FIG. 1 shows a schematic perspective illustration of a protective helmet having a jet helmet part and a chin part according to an exemplary embodiment.

FIG. 1 shows a protective helmet 100 for a motorcyclist, comprising a jet helmet part 1 and a strap-shaped chin part 2. The chin part 2 is removably held via a coupling part 3 each fitted at the sides, approximately in an ear area of the jet helmet part 1, and can be swiveled upward and downward in arrow directions 4 instead of around a pivot as in a conventional rotary joint. The chin part 2 is shown in a lower, flipped-down integral helmet position and can be swiveled upward through about 90° into a jet helmet position.

The protective helmet has a visor 5 made of transparent plastic, which is fitted to the jet helmet part 1 such that it can be swiveled in arrow directions 6 independently of the chin part 2. The visor 5 and the chin part 2 are illustrated as sectioned and with dashed outlines in the area of the coupling part 3, in order to illustrate their position on the protective helmet. The two coupling parts 3 of the helmet permit repeated removal and assembly of the chin part 2 with the jet helmet part 1. For the purpose of removal, a user pulls the chin part 2 off the jet helmet part 1 in an uncoupling direction 8. For assembly, the chin part 2 is pushed onto the jet helmet part 1 in a coupling direction 9.

Figure 2:
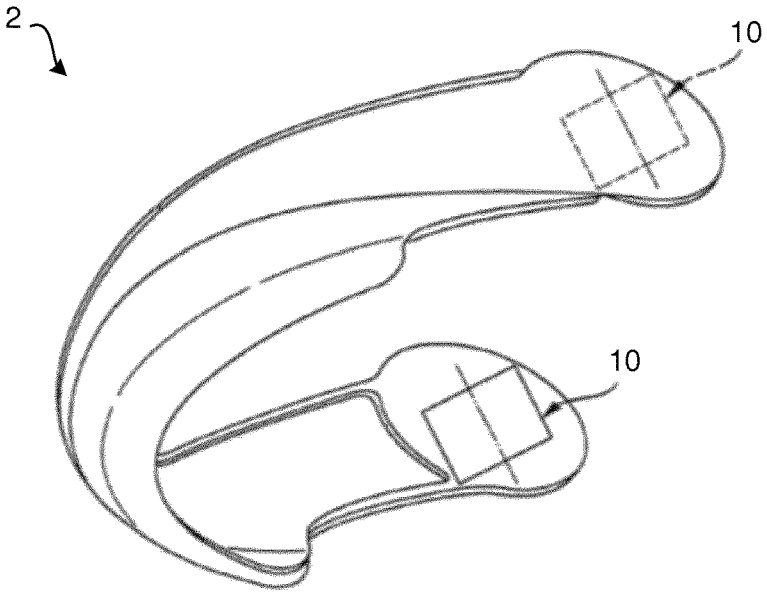
FIG. 2 shows a schematic perspective illustration of a chin part removed from the jet helmet part according to an exemplary embodiment.

The state of the chin part 2 removed from the jet helmet part 1 is shown in FIG. 2, wherein the chin part 2 has been pulled off in the uncoupling direction 8 by the user following the opening of the coupling part 3.

Figure 3:
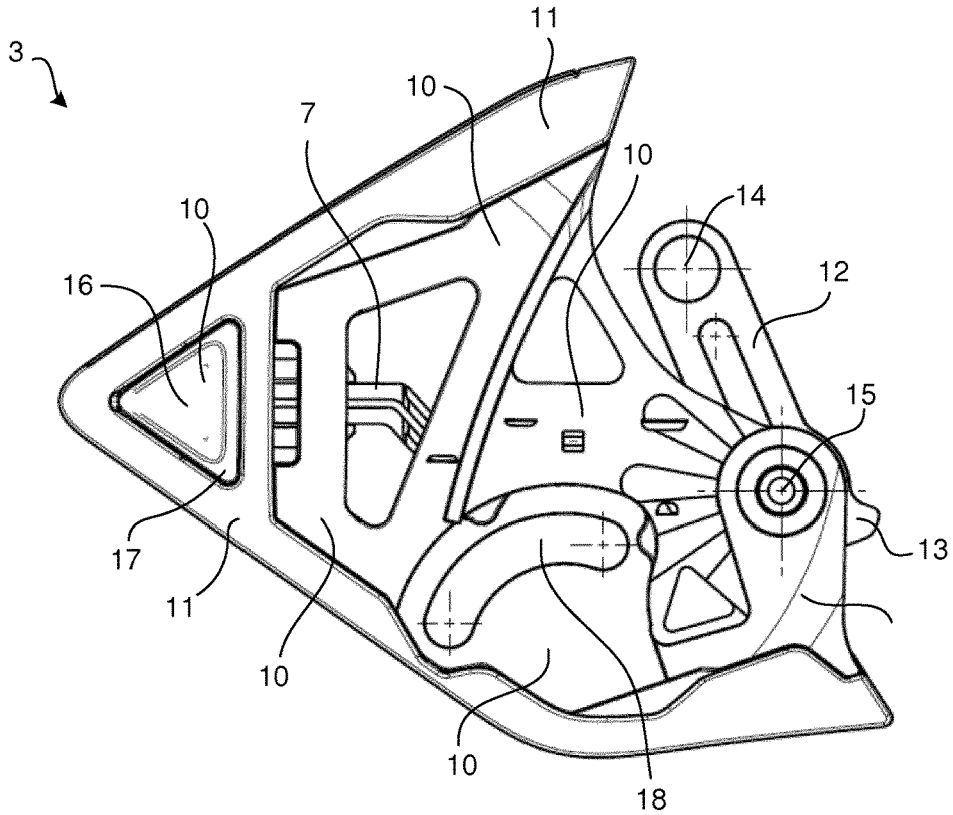
FIGS. 3 to 8 show various schematic illustrations of a coupling part of a protective helmet described here according to a further exemplary embodiment.
Figure 4:
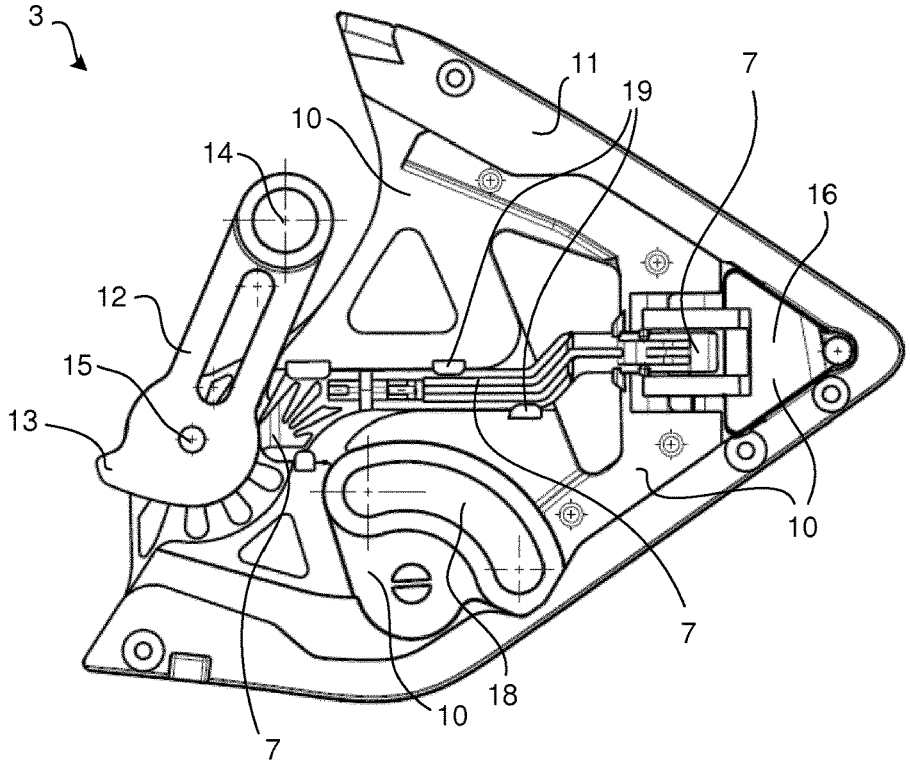
Figure 5:
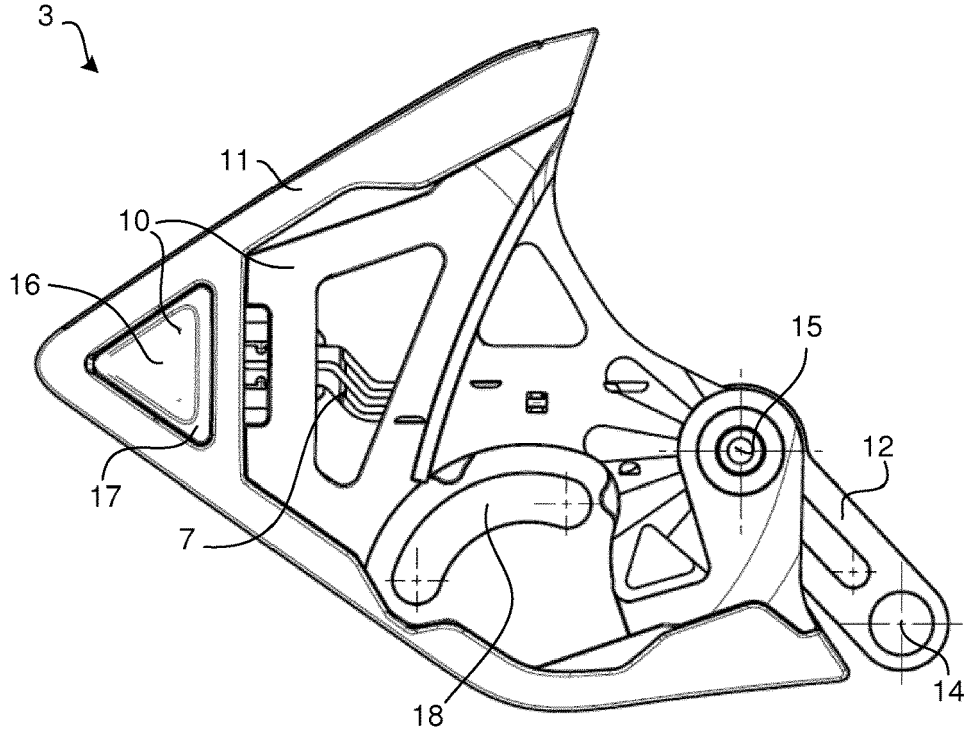
Figure 6:
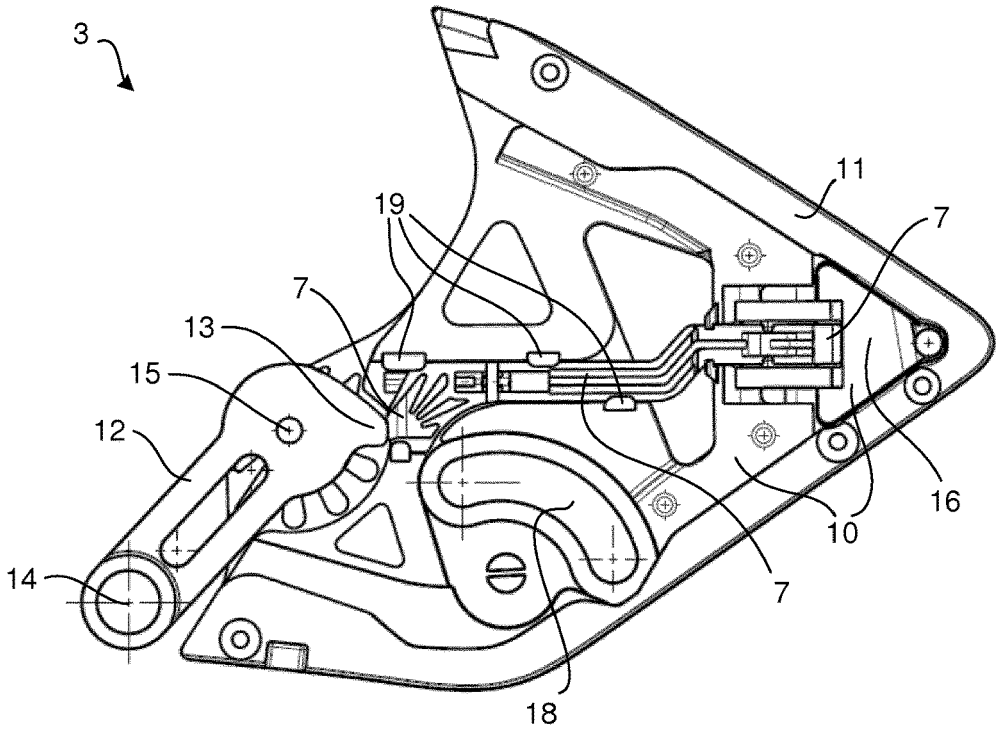

FIGS. 3 to 8 show various schematic illustrations of a coupling part 3 according to an exemplary embodiment. FIGS. 3, 4, 7 and 8 show a state of the coupling part 3 which in particular can occur in the jet helmet position. FIGS. 5 and 6, on the other hand, show a state of the coupling part 3 as occurs in particular in the integral helmet position.

The coupling part 3 has a first coupling element 10, which is fixed to the chin part 2, and a second coupling element 11, which is fixed to the jet helmet part 1. The first coupling element 10 is formed as a one-piece plastic part and has a latching lug 16 which, for a releasable form-fitting coupling, can latch with a latching recess 17 in the second coupling element 11 which, in the exemplary embodiment shown, is likewise formed as a one-piece plastic part.

The coupling part 3 is formed in such a way that, by means of the swiveling mechanism by means of which the chin part 2 is swiveled relative to the jet helmet part 1, a locking mechanism is activated. When the protective helmet 100 is changed from the jet helmet position to the integral helmet position, a blocking slider 7 is displaced by a locking cam 13 of a swivel arm 12, which is connected to the chin part 2 via a first joint 14 and to the first coupling element 10 via a second joint 15, in such a way that uncoupling of the coupling elements 10, 11 is blocked. In particular, the blocking slider 7 is displaced in such a way that an unhooking movement for releasing the latching of latching lug 16 and latching recess 17 is blocked by the arrangement of the blocking slider 7, since the blocking slider 7 is arranged behind the latching lug 16 in the direction of the unhooking movement. The blocking of the unhooking movement by the blocking slider 7 is illustrated in FIGS. 5 and 6.

When the protective helmet 100 is changed from the integral helmet position to the jet helmet position, as illustrated in FIGS. 3 and 4, the swivel arm 12 is rotated in such a way that the blocking of the unhooking movement is released, since the locking cam 13 of the swivel arm 12 no longer displaces the blocking slider 7 behind the latching lug 16.

The first coupling element 10 has a plurality of guide elements 19, which are formed as plastic hooks and by means of which the blocking slider 7 is displaceably supported. The blocking slider 7 is preferably formed as a one-piece plastic component.

Furthermore, the first coupling element 10 has a slotted guide 18, in which a guide pin (not shown), which is fixed to the chin part 2, is guided. The guide pin is connected to the first coupling element 10 via a spring (not shown).

Figure 7:
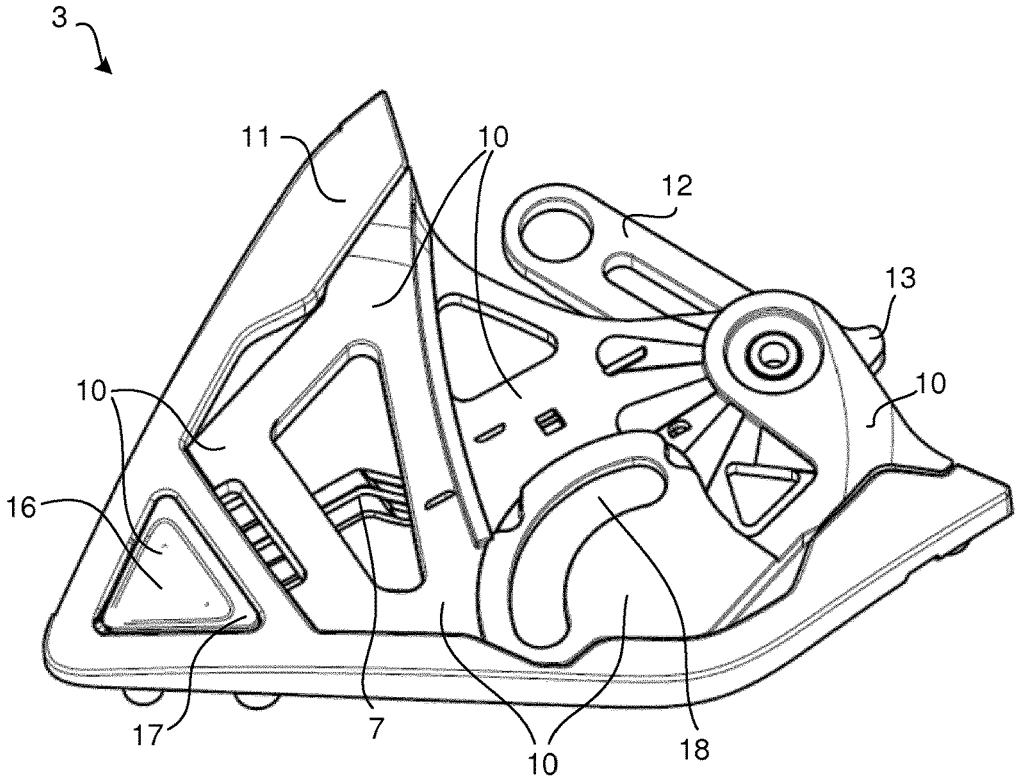
Figure 8:
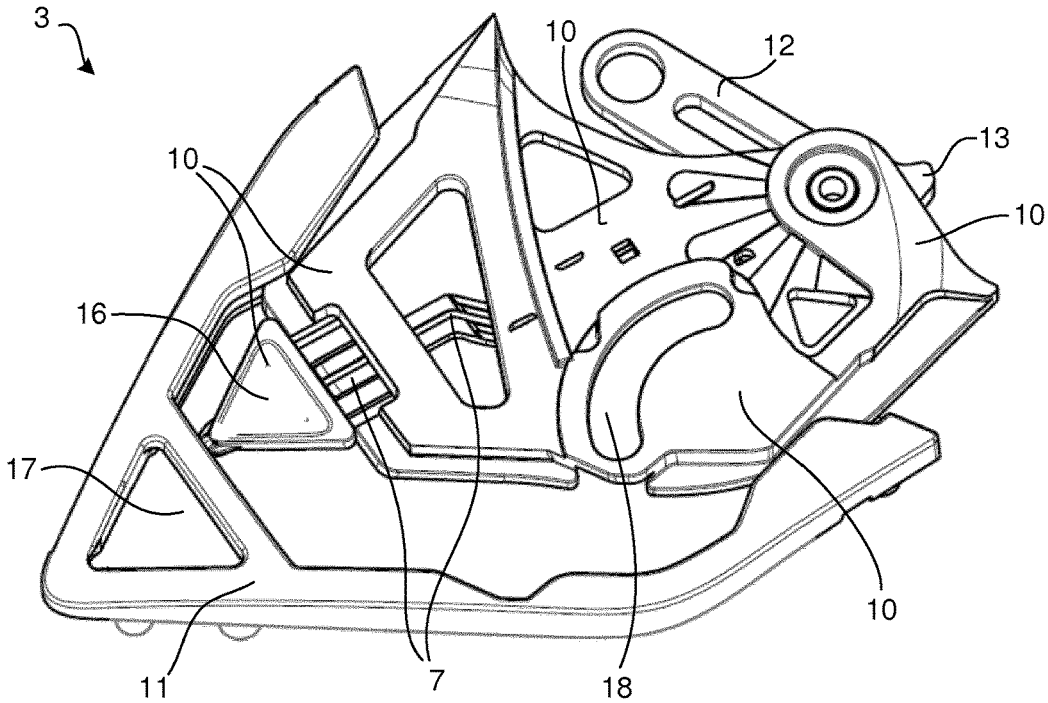

FIGS. 7 and 8 show further perspective views of the coupling part 3 in the jet helmet position, wherein the first coupling element 10 is uncoupled from the second coupling element 11 in FIG. 8 following pressure on the latching lug 16, so that the chin part 2 is detached from the jet helmet part 1.

The features described in the exemplary embodiments shown can also be combined with one another in accordance with the further exemplary embodiments. Alternatively or additionally, the exemplary embodiment shown in the Figures can have further features according to the embodiments of the general description.

LIST OF REFERENCE CHARACTERS

1 Jet helmet part
2 Chin part
3 Coupling part
4 Swiveling directions
5 Visor
6 Flip-up directions
7 Blocking slider
8 Uncoupling direction
9 Coupling direction
10 First coupling element
11 Second coupling element
12 Swivel arm
13 Locking cam
14 First joint
15 Second joint
16 Latching lug
17 Latching recess
18 Slotted guide
19 Guide element
100 Protective helmet The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed is:

1. A protective helmet, comprising:

a jet helmet part;

a chin part, wherein the jet helmet part and the chin part are releasably connected to each other via a coupling part;

wherein the chin part and the jet helmet part are swivelable by a swiveling mechanism relative to each other in swiveling directions between an integral helmet position and a jet helmet position;

wherein the coupling part includes a first coupling element on the chin part and a second coupling element on the jet helmet part which are interengageable for mutual releasably form-fitting coupling; and a locking mechanism that is actuatable by the swiveling mechanism, wherein the locking mechanism includes a blocking slider, wherein, in the integral helmet position, the blocking slider blocks the first coupling element such that uncoupling of the first and the second coupling elements is blocked and, in the jet helmet position, the blocking slider does not block the first coupling element such that uncoupling of the first and the second coupling elements is possible.

2. The protective helmet as claimed in claim 1, wherein the protective helmet is a motorcycle helmet.

3. The protective helmet as claimed in claim 1, wherein the swiveling mechanism comprises a swivel arm, wherein the first coupling element is connected to the chin part by the swivel arm, wherein the swivel arm has a locking cam, and wherein the blocking slider is displaceable during swiveling from the jet helmet position into the integral helmet position by the locking cam such that the first coupling element is blocked.

4. The protective helmet as claimed in claim 3, wherein the swivel arm is connected to the chin part via a first joint and to the first coupling element via a second joint.

5. The protective helmet as claimed in claim 1, wherein the second coupling element has a female coupling member and wherein the first coupling element has a male coupling member that is latchable to the female coupling member.

6. The protective helmet as claimed in claim 1, wherein the first coupling element has a latching lug and wherein the second coupling element has a latching recess.

7. The protective helmet as claimed in claim 6, wherein the coupling part is configured such that latching of the latching lug with the latching recess is releasable by an unhooking movement and wherein the blocking slider is configured such that the unhooking movement is blockable by the blocking slider.

8. The protective helmet as claimed in claim 6, wherein the blocking slider in the integral helmet position is arranged behind the latching lug in a direction of the unhooking movement.

9. The protective helmet as claimed in claim 7, wherein the blocking slider in the integral helmet position is arranged behind the latching lug in a direction of the unhooking movement.

10. The protective helmet as claimed in claim 1, wherein the first coupling element has a slotted guide and wherein a guide pin that is fixed to the chin part is guided in the slotted guide.

11. The protective helmet as claimed in claim 10, wherein a spring element connects the guide pin to the first coupling element.

12. The protective helmet as claimed in claim 1, wherein the first coupling element is formed in one piece.

13. The protective helmet as claimed in claim 1, wherein the first coupling element has a guide in which the blocking slider is guidable.

14. The protective helmet as claimed in claim 13, wherein the guide has a plurality of guide elements.

15. The protective helmet as claimed in claim 1, wherein the first coupling element is swivelably connected to the chin part.

* * * * *